US005522548A

United States Patent [19]

Gallien et al.

[11] Patent Number: 5,522,548

[45] Date of Patent: Jun. 4, 1996

[54] AEROSOL VALVE HAVING SWIVELLY MOUNTED DIP TUBE

[75] Inventors: Walter R. Gallien, Raymond; Robert J. St. Onge, Manchester, both of N.Y.

[73] Assignee: Summit Packaging Systems, Inc., Manchester, N.H.

[21] Appl. No.: 318,975

[22] Filed: Oct. 6, 1994

[51] Int. Cl.[6] ..... B05B 7/32

[52] U.S. Cl. ..... 239/337; 239/573; 239/588; 222/382

[58] Field of Search ..... 239/333, 337, 239/372, 573, 342, 354, 587.3, 587.4, 588; 222/464.3, 382, 211

[56] References Cited

U.S. PATENT DOCUMENTS

| | | | |
|---|---|---|---|
| 2,315,263 | 3/1943 | Lindsay | 239/342 X |
| 2,569,975 | 10/1951 | Cone | 222/464.3 X |
| 2,797,965 | 7/1957 | McKernan | 239/337 |
| 2,920,798 | 1/1960 | Samuel | 222/464.3 X |
| 5,381,961 | 1/1995 | Evans et al. | 239/222 |

FOREIGN PATENT DOCUMENTS

| | | | |
|---|---|---|---|
| 25814 | of 0000 | Germany | 239/342 |

*Primary Examiner*—Andres Kashnikow
*Assistant Examiner*—Lesley D. Morris
*Attorney, Agent, or Firm*—Dallett Hoopes

[57] ABSTRACT

The swivel joint comprises a housing holding a resilient annulus which in one embodiment sealingly engages an upper portion of a tubular head at the top of the dip tube, and an inward annular lip in the lower part of the housing swivelly supports the head from below. In another embodiment the resilient annulus in the housing serves to both seal and swivelly support the dip tube by its head.

8 Claims, 3 Drawing Sheets

AEROSOL VALVE HAVING SWIVELLY MOUNTED DIP TUBE

BACKGROUND OF THE INVENTION

This invention relates to aerosol valves. More specifically, this invention relates to means for assuring that the lower end of the dip tube of such valves remains submerged in liquid to the maximum possible extent.

With present environmental laws restricting the use of chlorofluorocarbons as propellants; aerosol packages are now often driven by compressed gasses such as carbon dioxide or nitrogen. This presents a significant problem: chlorofluorocarbons have recovery power as aerosol propellants. On drop of pressure in the container some of the cfc propellant changes phase to build the pressure back up. In contrast, of course, compressed gases do not recover once the pressure drops.

As a result of this less-than-ideal characteristic of compressed gases as propellants, it is absolutely essential that there be no escape of compressed gases up the dip tube as would occur if the can is tipped during usage and the bottom of the dip tube is exposed to the head space. For this reason it is desirable to provide means to assure that the lower end of the dip tube stay submerged in liquid product to the maximum possible extent.

The prior art has considered keeping the dip tube submerged. Applicants have noted structure in the prior art aimed at accomplishing this objective. It is interesting to note that the aim in the past has been from the point of view of efficiently using the last bit of liquid in the container rather than precluding gas escape. For instance, a U.K. published application of an invention by Fumio Aoki 2,031,526, published Apr. 23, 1980 shows a dip tube having bellows-like configuration with a weight at its lower end so that it operates in any position and so that "the liquid material in the spray vessel can be completely used".

Other examples of flexible dip tubes with weighted ends are:

2,483,661—Neas
4,830,235—Miller
3,130,519—Mauget
5,195,664—Rhea
3,490,656—Taschner
Australian 258,883
3,547,296—Greenberg
British 2,136,057A
4,273,272—Blanc The flexibility of such dip tubes has drawn the criticism of the industry in that aerosol assemblies including such tubes have been awkward to handle in production filling lines. Further, such tubes being very flexible have also been susceptible to kinking and closure at the kinks. A still further objection is that the weight in the end of the tubes has made a clunking noise when the container is handled, leading the unsophisticated to believe that something inside is broken. There have been unwarranted complaints.

SUMMARY OF THE INVENTION

In the present invention the objective of keeping the end of the tube submerged to the greatest possible extent is met by using a stiff, rigid, straight dip tube, the upper end of which is attached in a kind of swivel joint to the bottom of the valve body. The swivel joint of the invention, two embodiments of which are disclosed, provides sure-fire dip tube support and sealing means so that there is no risk of leakage of the precious head space pressure directly into the swivel joint: instead the pressure works on the liquid to drive it up the dip tube and through the joint as it should.

Specifically, the swivel joint comprises a housing holding a resilient annulus which in one embodiment sealingly engages an upper portion of a tubular head at the top of the dip tube, and an inward annular lip in the housing below the annulus supports the head from below. In another embodiment the resilient annulus fin the housing serves to both seal and support the dip tube by its head.

BRIEF DESCRIPTION OF THE DRAWINGS

Other objects and features of the invention will be apparent to those skilled in the art from a study of the following specification and the drawings, all of which disclose non-limiting embodiments of the invention. In the drawings.

DESCRIPTION OF THE PREFERRED EMBODIMENT

Figure 1:
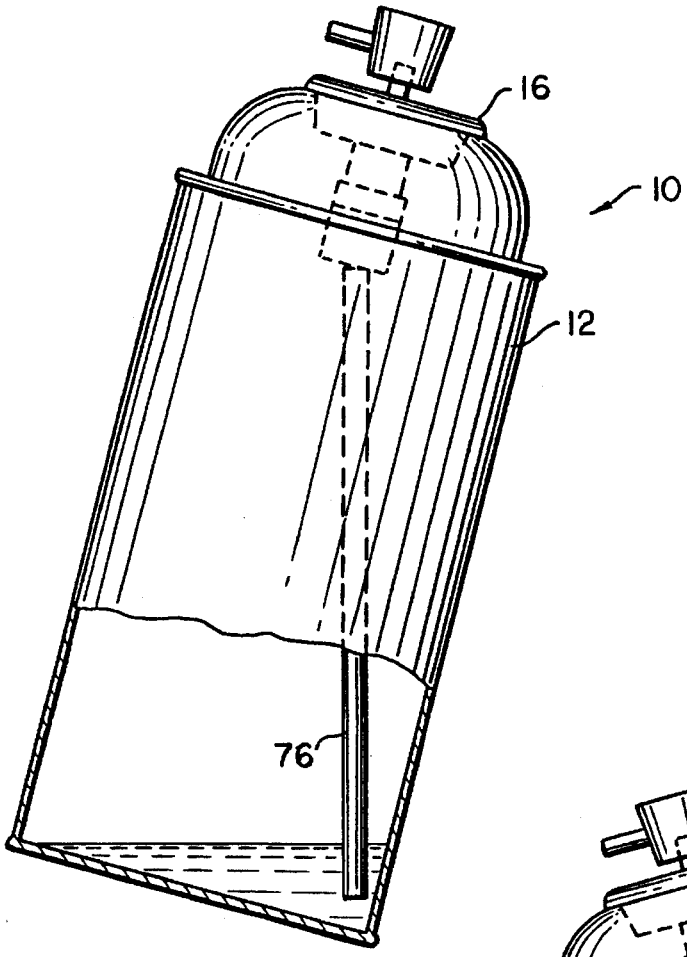
FIG. 1 is a plan view partly in action of a flat bottomed aerosol container fitted with a valve embodying the invention in phantom outline.
Figure 3:
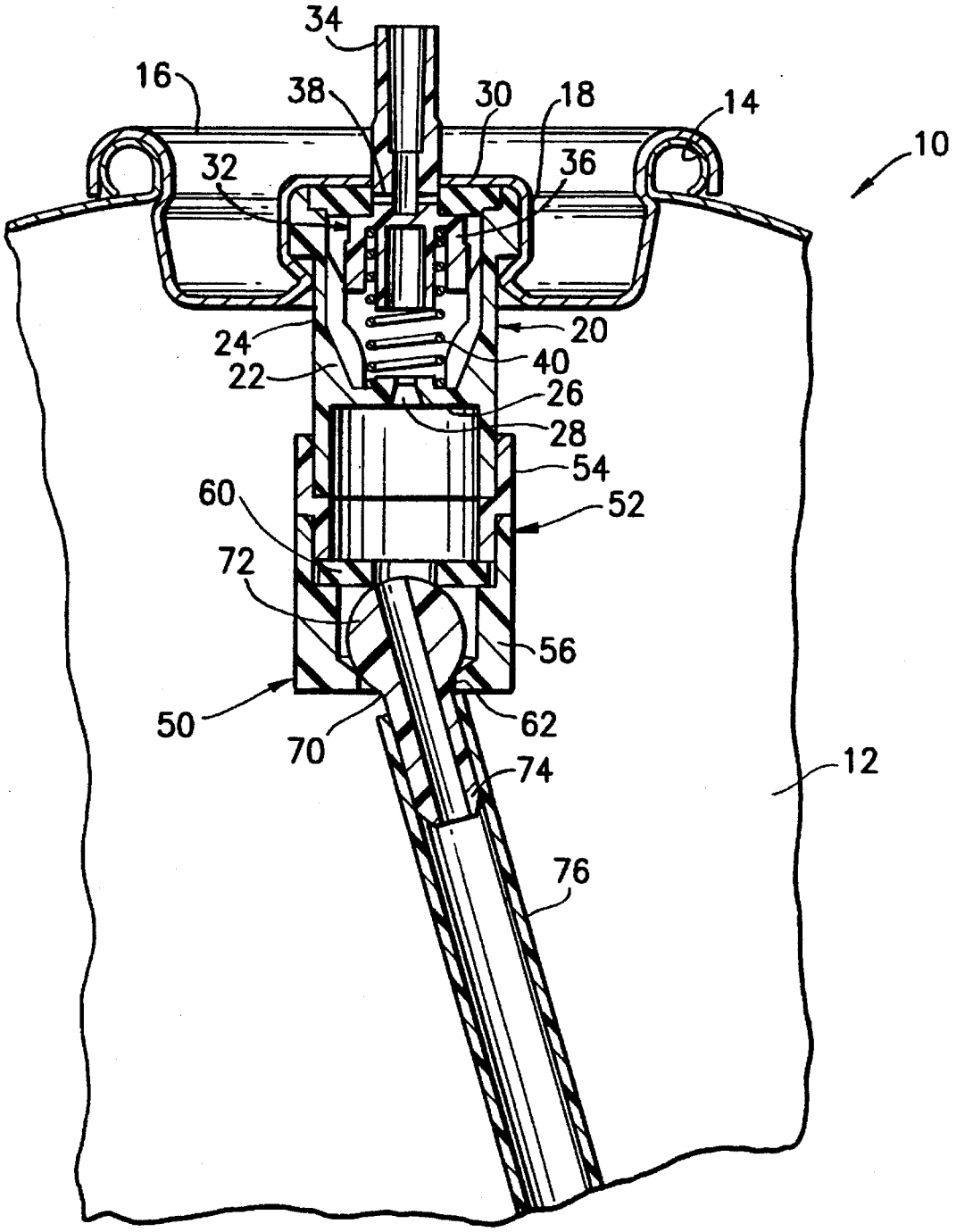
FIG. 3 is an enlarged centerline section of the valve of FIG. 1.
Figure 4:
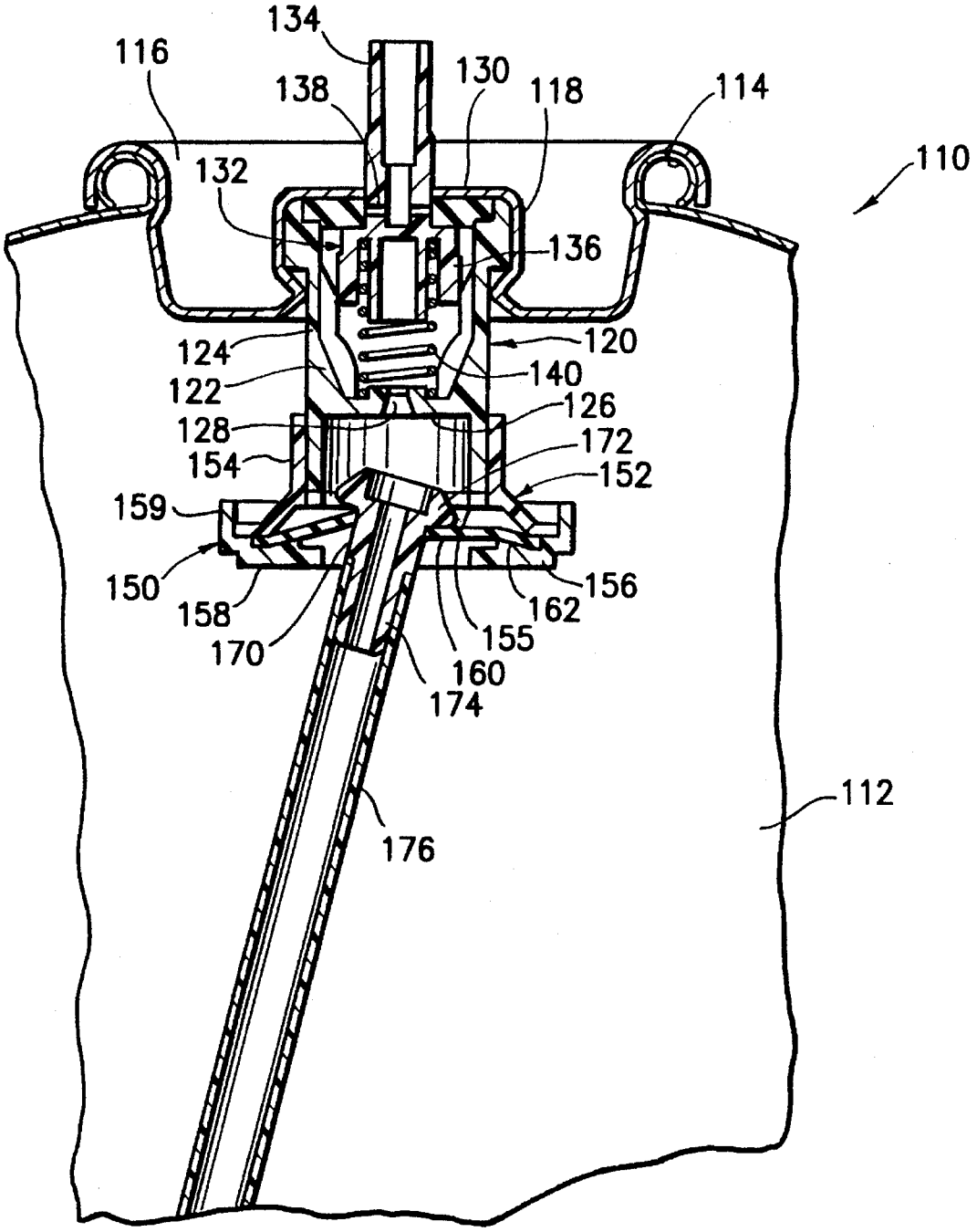
FIG. 4 is a view similar to FIG. 3 of a modified form of the invention.

An aerosol dispenser embodying the invention is shown in FIG. 1 and generally designated 10. It comprises a container 12 having a bead 14 (FIG. 3) about the mouth of its upper end. Into this bead is crimped in the usual way the curl of an aerosol mounting cup 16.

A central portion of the bottom wall of the cup 16 is formed with an upward pedestal 18 and a central opening. Into the pedestal is crimped as is conventional an aerosol valve 20 having a cup-shaped body 22 comprising the annular side wall 24 and the floor 26, the floor having an opening 28. The valve may be of the vertical or tilt type as are known in the art. The upper end of the body 22 is thickened and notched in the conventional manner and receives in the notch an annular gasket 30. Gasket 30 is sealingly secured between the top of body 22 and the top wall of the pedestal 18.

A valve element 32 is defined by a tubular upward stem 34 sealingly surrounded by the gasket 30 and an enlarged head or base 36 inside the body and normally seated against the underside of the gasket. The stem 34 has an outward passage 38 therethrough. The gasket 30 normally seals the passage 38.

A spring 40 is disposed in the valve body against the floor 26 forcefully engaging the valve element 32 to urge the valve element into seating position. When the stem is depressed, the passage 38 clears the underside of the gasket for dispensing in the usual way. As shown, the side wall 24 extends down beyond the floor 26.

The swivel dip tube assembly 50 will now be described. It comprises a housing 52 which includes a collar or upper section 54 ring or lower section 56. As shown, the housing is annular and the upper section 54 fits over the side wall 24 of the valve body.

The upper section 54 of the housing 52 has a reduced lower portion over which telescopes the upper end of the lower section 56 of the housing 52. Clampingly and sealingly disposed between the upper section 54 and lower section 56 is the resilient annulus 60. The lower section 56 is formed with an inward annular retaining lip 62 spaced downward but aligned with the annulus 60. Both the upper and the lower sections 54, 56 have annular upwardly facing stop shoulders to assist in assembly.

A tubular dip tube fitting 70 is provided and comprises a tubular head 72 and a nipple 74. As shown, the head is larger in diameter than the retaining lip 62 and swivels therein. The annulus 60 sealingly engages an upper portion of the head 72, the opening through the fitting coinciding at all times with the opening in the annulus 60 so that passage of liquid is not cut off. Nipple 74 extends on down through the retaining lip 62. The head 72 is thus swivelly trapped between the retaining lip 62 and the annulus 60 which it sealingly engages.

A straight, preferably rigid dip tube 76 completes the assembly. It telescopes sealingly over the nipple 74 and has sufficient mass when the dispenser is tipped to swivel the fitting 70 within its entrapment so that the lower end of the tube 74 is emersed in liquid to the greatest possible extent.

The material of the housing 52, both the upper section 54 and the lower section 56, may be acetal or Nylon, a hard plastic similar to the plastic of the valve body 22 and valve element 32. The annulus 60 may be a Buna or a Nitrile rubber or other elastomer. The fitting may also be acetal. Preferably, the dip tube length 76 is of polypropylene.

Figure 2A:
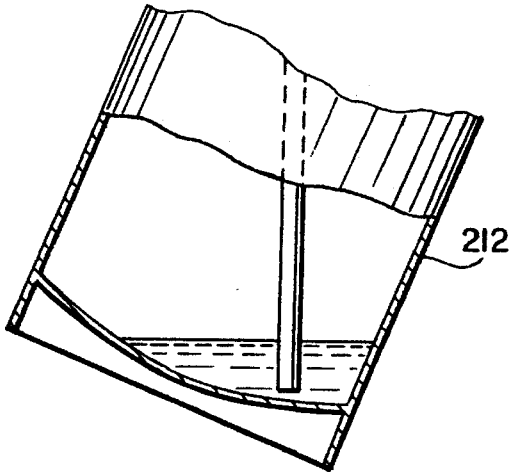
FIG. 2*a* is a fragmentary view of structure similar to FIG. 2 of a can having an upwardly concave bottom.

The valve embodying the invention is shown installed in a container 12 which has a flat floor. The tube 76 normally would be in vertical position, its length being such as to barely clear the bottom wall and on tipping (FIG. 1) of the container, the tube would swivel to adjacent the margin thereof, perhaps resting against the side wall of the container. The container can, of course, have a domed or concave floor as shown in FIGS. 2, 2*a*, with beneficial results.

DESCRIPTION OF MODIFICATION

Figure 2:
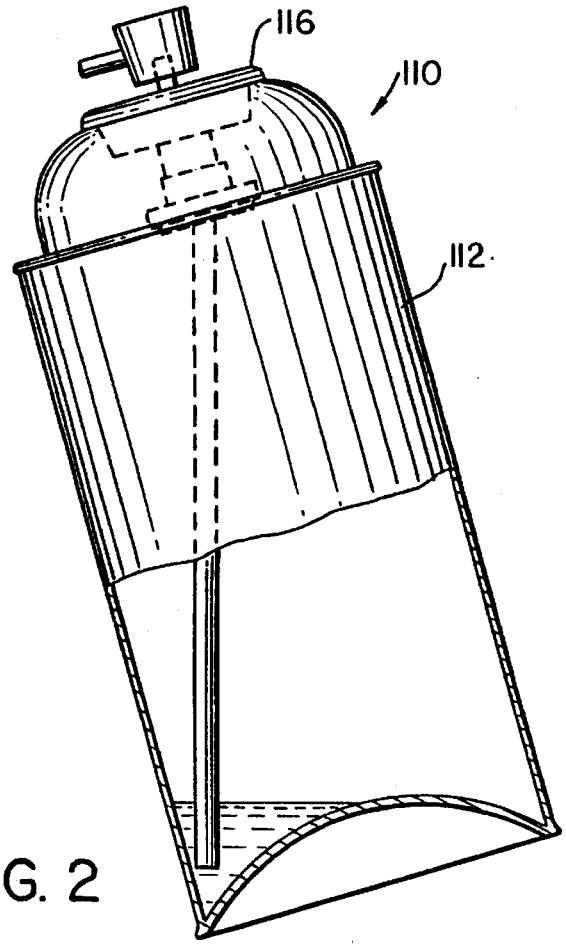
FIG. 2 is a view similar to FIG. 1 but showing a modified form of the invention in phantom outline in a domed bottom can.

An aerosol dispenser having a valve embodying a modified form of the invention is shown in FIG. 2 and generally designated 110. It comprises a container 112 having a bead 114 about the mouth of its upper end. Into this bead is crimped in the usual way the curl of an aerosol mounting cup 116.

A central portion of the bottom wall of the cup 116 is formed with an upward pedestal 118 and a central opening. Into the pedestal is crimped as is conventional an aerosol valve 120 having a cup-shaped body 122 comprising the annular side wall 124 and the floor 126, the floor having an opening 128. The valve may be of the vertical or tilt type as are known in the art. The upper end of the body 122 is thickened and notched in the conventional manner and receives in the notch an annular gasket 130. Gasket 130 is sealingly secured between the top of body 122 and the top wall of the pedestal 118.

A valve element 132 is defined by a tubular upward stem 134 sealingly surrounded by the gasket 130 and an enlarged head or base 136 inside the body and normally seated against the underside of the gasket. The stem 134 has an outward passage 138 therethrough. The gasket 130 normally seals the passage 138.

A spring 140 is disposed in the valve body against the floor 126 and forcefully engaging the valve element 132 to urge the valve element into seating position. When the stem is depressed, the passage 138 clears the underside of the gasket for dispensing in the usual way. As shown, the side wall 124 extends down beyond the floor 126.

The swivel dip tube assembly 150 will now be described. It comprises a housing a retaining and sealing means which includes an upper section 154, a kind of collar, and a lower section 156 a ring. As shown, the housing is annular and the upper section 154 fits over the side wall 124 of the valve body and is secured thereto.

The upper section 154 of the housing 152 has an inward stop rib 155 which in assembly engages the bottom of the side wall 124. It has an outwardly flaring lower portion over which telescopes the upper end of the lower section 156 of the housing 152. The lower section 156 comprises a molded annular ring 158 with an upward peripheral rim 159. The ring may have a downwardly and outwardly sloping upper floor surface 162 as shown. Clampingly and sealingly disposed between the upper section 154 and lower section 156, which are pressed or welded together, is the resilient annulus 160. The annulus 160 may be upwardly frusto conical, sloping upwardly toward the center as shown, the sections 154 and 156 are secured together with the resilient annulus inbetween to complete the retaining and sealing means.

A tubular dip tube fitting 170 is provided and comprises an enlarged head 172 and a nipple 174. As shown, the head is larger in diameter than the opening in the resilient annulus 160 which snugly engages the nipple 174 under the head. Nipple 174 extends on down through the annulus 160. The head 172 is thus swivelly supported by the resilient annulus 160 which it sealingly engages.

A straight dip tube 176 completes the assembly. It telescopes sealingly over a reduced lower section of the nipple 174 as shown. The tube 176 has sufficient mass to swivel the fitting 170 when the dispenser is tipped in the flexible resilient annulus so that the lower end of the tube 176 is emersed in liquid to the greatest possible extent.

Again, the material of the housing 152, both the upper section 154 and the lower section 156, may be acetal or Nylon, a hard plastic similar to the plastic of the valve body 122 and valve element 132. The annulus 160 may be a Buna or a Nitrile rubber or other elastomer. The fitting 170 may also be acetal. Preferably, the dip tube length 176 is of polypropylene.

The valve embodying the invention is shown (FIG. 2) installed in a container 112 which has a conventional domed floor. As shown, the tube 176 is of such a length as to reach down into the annular zone surrounding the domed bottom. Because of its weight, the tube will seek the lowest part of the zone which will, of course, be where the liquid has accumulated when the dispenser is tipped. Modified container 12 (FIG. 1) can have a flat floor. Modified container 212 (FIG. 2*a*) has a concave floor. Both can enjoy the beneficial results of the invention.

Variations of the structure shown are envisioned. For instance, some of the benefits of the invention may be enjoyed by connecting the lower section of the housing directly to the lower end of the valve body, with or without modification of the valve body. In this arrangement the lower portion of the valve body can be thought of as the dip tube assembly support means.

Thus, while the invention has been shown in only one embodiment, it is not so limited but is of a scope defined by the following claim language which may be broadened by an extension of the right to exclude others from making or using the invention as is appropriate under the doctrine of equivalents.

What is claimed is:

1. An aerosol valve comprising:

a. a cup-shaped valve body defined by an annular side wall having a top and a floor with an opening therethrough, b. an annular resilient gasket having an underside sealingly secured across the top of the valve body, c. a valve element defined by a tubular upward stem sealingly surrounded by the gasket, and an enlarged base normally seating against the underside of the gasket, the tubular stem having outward passage means adjacent the base, the head normally engaging the gasket and sealing the passage means, d. spring means in the valve body urging the valve element head toward engagement with the gasket, and e. a dip tube assembly comprising 1) a dip tube having a tubular enlarged head at its upper end, and 2) swivel housing means secured to the lower end of the valve body and communicating with the opening in the floor and containing a resilient flexible annulus having a central hole of a rim receiving the dip tube and being of upward frusto-conical shape and the head of the dip tube riding on the rim thereby sealingly and swivelly supporting the dip tube by engagement with its head.

2. An aerosol valve comprising:

a. a cup-shaped valve body defined by an annular side wall having a top and a floor with an opening therethrough, the side wall extending downward below the floor and having a lower end, b. an annular resilient gasket having an underside sealingly secured across the top of the valve body, c. a valve element defined by a tubular upward stem sealingly surrounded by the gasket, and an enlarged base normally seating against the underside of the gasket, the tubular stem having outward passage means adjacent the base, the base normally engaging the gasket and sealing the passage means, d. spring means in the valve body urging the valve element base upward toward engagement with the gasket, e. a dip tube assembly comprising 1) annular dip tube retaining and sealing means secured across the lower end of the annular side wall and comprising a tubular housing formed of two annular parts secured coaxially together and being secured to the lower end of the side wall and formed with an inward annular retaining lip about the lower end thereof, and a resilient annulus sealingly disposed across the housing above the lip and clamped between the two parts, 2) a generally vertically disposed tubular dip tube fitting having an enlarged head at its upper end, an upper portion of the head sealingly engaging about the annulus, the head being larger than the annular retaining lip and having a lower portion supportingly engaging in the lip, the lower end of the fitting extending through the lip, 3) a rigid dip tube operatively and fixedly secured to the lower end of the tubular dip tube fitting whereby the fitting and dip tube is swivelly supported in the retaining and sealing means.

3. An aerosol valve comprising:

a. a cup-shaped valve body defined by an annular side wall having a top and a floor with an opening therethrough, the side wall extending downward below the floor, b. an annular resilient gasket having an underside and sealingly secured across the top of the valve body, c. a valve element defined by a tubular upward stem sealingly surrounded by the gasket, and an enlarged base normally seating against the underside of the gasket, the tubular stem having outward passage means adjacent the base, the base normally engaging the gasket sealing the passage means, d. spring means in the valve body urging the valve element base upward toward engagement with the gasket, e. a dip tube assembly comprising:

1) annular dip tube retaining and sealing means comprising a collar secured to the side wall, a rigid ring therebelow and a flexible annulus, the ring clamping the flexible annulus against the collar, the retaining and sealing means having an inward retaining lip therein and a sealing element, 2) a tubular dip tube fitting having an enlarged head at its upper end, the fitting sealingly engaging the retaining and sealing means and being swivelly supported thereby, the lower end of the fitting extending down through the retaining and sealing means, 3) a rigid dip tube operatively and fixedly secured to the lower end of the tubular dip tube fitting whereby the fitting and dip tube are swivelly supported in the retaining and sealing means.

4. An aerosol valve as claimed in claim 3 wherein the flexible annulus engages, supports and seals the underside of the head.

5. An aerosol valve as claimed in claim 3 wherein the ring has an inward annular flange spaced downward from the flexible annulus and the enlarged head of the fitting is spherical and pivotally disposed between the flexible annulus and the annular flange, the flexible annulus sealing an upper portion of the spherical head.

6. An aerosol valve comprising:

a. a cup-shaped valve body defined by an annular side wall having a top and a floor with an opening therethrough, the side wall extending downward below the floor, b. an annular resilient gasket having an underside and sealingly secured across the top of the valve body, c. a valve element defined by a tubular upward stem sealingly surrounded by the gasket, and an enlarged head normally seating against the underside of the gasket, the tubular stem having outward passage means therethrough adjacent the head, the gasket normally sealing the passage means, d. spring means in the valve body urging the valve element upward toward seating, e. a dip tube assembly comprising 1) annular dip tube retaining and sealing means secured across the lower end of the annular side wall and having a resilient annulus therein, 2) a generally vertically disposed tubular dip tube fitting having an enlarged head and depending nipple, the head sealingly and supportedly engaging in the opening in the resilient annulus, the head being larger than the opening in the resilient annulus and the nipple extending down through the resilient annulus, 3) a rigid dip tube operatively and fixedly secured to the nipple of the tubular dip tube fitting whereby the fitting and dip tube is swivelly supported in the resilient annulus.

7. An aerosol valve as claimed in claim 6 wherein the retaining and sealing means also comprises a collar engaging the side wall, the collar having a downward and outward annular flange, and a clamping ring which secures the resilient annulus against the flange.

8. An aerosol valve as claimed in claim 7 wherein the ring has an upper face with an upwardly and inwardly inclined annular surface engaging the annulus and the annulus is frustoconical in shape.

* * * * *